US010129656B2

(12) United States Patent
Buccafusca

(10) Patent No.: US 10,129,656 B2
(45) Date of Patent: Nov. 13, 2018

(54) ACTIVE TEMPERATURE CONTROL OF PIEZOELECTRIC MEMBRANE-BASED MICRO-ELECTROMECHANICAL DEVICES

(75) Inventor: Osvaldo Buccafusca, Fort Collins, CO (US)

(73) Assignee: Avago Technologies International Sales Pte. Limited, Singapore (SG)

( * ) Notice: Subject to any disclaimer, the term of this patent is extended or adjusted under 35 U.S.C. 154(b) by 2756 days.

(21) Appl. No.: 12/363,689

(22) Filed: Jan. 30, 2009

(65) Prior Publication Data

US 2010/0195851 A1 Aug. 5, 2010

(51) Int. Cl.

| | |
|---|---|
| ***H04R 1/00*** | (2006.01) |
| ***H04R 19/00*** | (2006.01) |
| ***H04R 17/02*** | (2006.01) |
| ***B06B 1/02*** | (2006.01) |
| *H04R 9/02* | (2006.01) |

(52) U.S. Cl.

CPC ..... *H04R 19/005* (2013.01); *B06B 1/0292* (2013.01); *H04R 17/02* (2013.01); *H04R 9/022* (2013.01); *H04R 2201/003* (2013.01)

(58) Field of Classification Search

CPC ..... H04R 9/022; H04R 2217/00; H04R 2217/01; H04R 2217/03

USPC ..... 381/190, 397

See application file for complete search history.

(56) References Cited

U.S. PATENT DOCUMENTS

| | | | |
|---|---|---|---|
| 2,875,355 | A | 2/1959 | Petermann |
| 2,943,278 | A | 6/1960 | Mattiat |
| 2,976,501 | A | 3/1961 | Mattiat |
| 3,384,767 | A | 5/1968 | Arnold |
| 4,129,799 | A | 12/1978 | Green |
| 4,529,904 | A | 7/1985 | Hattersley |
| 4,868,446 | A | 9/1989 | Kumada |
| 4,985,926 | A | 1/1991 | Foster |
| 5,587,620 | A | 12/1996 | Ruby et al. |
| 5,663,505 | A | 9/1997 | Nakamura |
| 5,784,340 | A | 7/1998 | Kanai |
| 5,814,922 | A | 9/1998 | Uchino et al. |
| 5,873,153 | A | 2/1999 | Ruby et al. |
| 6,040,654 | A | 3/2000 | Le Letty |
| 6,346,764 | B1 | 2/2002 | Boyd |
| 6,362,559 | B1 | 3/2002 | Boyd |
| 6,377,137 | B1 | 4/2002 | Ruby |

(Continued)

FOREIGN PATENT DOCUMENTS

| | | |
|---|---|---|
| CA | 2268415 | 10/2000 |
| EP | 0451533 | 10/1991 |

(Continued)

OTHER PUBLICATIONS

Ried, Robert P., et al., "Piezoelectric Microphone with On-Chip CMOS Circuits", *Journal of Microelectromechanical Systems*, vol. 2, No. 3., (Sep. 1993),111-120.

(Continued)

*Primary Examiner* — Julio J Maldonado
*Assistant Examiner* — Stanetta Isaac

(57) ABSTRACT

In a representative embodiment, an apparatus, comprises a substrate; a microelectronic ultrasonic transducer (MUT) disposed over the substrate; and a thermoelectric device disposed proximate to the MUT and configured to provide heat to or remove heat from the MUT. A microelectromechanical MEMs device is also described.

18 Claims, 4 Drawing Sheets

(56) References Cited

U.S. PATENT DOCUMENTS

| | | | | |
|---|---|---|---|---|
| 6,462,631 | B2 | 10/2002 | Bradley et al. | |
| 6,469,597 | B2 | 10/2002 | Ruby et al. | |
| 6,472,954 | B1 | 10/2002 | Ruby et al. | |
| 6,507,583 | B1 | 1/2003 | Beasley | |
| 6,507,983 | B1 | 1/2003 | Ruby et al. | |
| 6,642,631 | B1 | 11/2003 | Clavette | |
| 6,667,566 | B2 | 12/2003 | Kim et al. | |
| 6,773,401 | B1 * | 8/2004 | Dreschel et al. | 600/459 |
| 6,919,669 | B2 | 7/2005 | Bryant et al. | |
| 7,224,105 | B2 | 5/2007 | Onishi et al. | |
| 2002/0030424 | A1 | 3/2002 | Iwata | |
| 2004/0190377 | A1 * | 9/2004 | Lewandowski et al. | 367/174 |
| 2005/0075573 | A1 * | 4/2005 | Park | A61B 8/00 600/459 |
| 2005/0194867 | A1 | 9/2005 | Kawakubo | |
| 2006/0163680 | A1 * | 7/2006 | Chen | 257/416 |
| 2008/0122317 | A1 | 5/2008 | Fazzio et al. | |
| 2008/0122320 | A1 | 5/2008 | Fazzio | |
| 2008/0257050 | A1 * | 10/2008 | Watanabe | G01S 7/521 73/627 |
| 2009/0001853 | A1 * | 1/2009 | Adachi et al. | 310/323.19 |
| 2009/0048522 | A1 * | 2/2009 | Huang | 600/459 |

FOREIGN PATENT DOCUMENTS

| | | |
|---|---|---|
| JP | 4959526 | 8/1972 |
| JP | 59019384 | 1/1984 |
| JP | 59146298 | 8/1984 |

OTHER PUBLICATIONS

Loeppert, Peter V., et al., "SiSonic—The First Commercialized MEMS Microphone", *Solid-State Sensors, Actuators, and Microsystems Workshop*, Hilton Head Island, South Carolina, (Jun. 4-8, 2006),27-30.

Niu, Meng-Nian et al., "Piezoelectric Bimorph Microphone Built on Micromachined Parylene Diaphragm", *Journal of Microelectromachanical Systems*, vol. 12. No. 6, (Dec. 2003),892-898.

* cited by examiner

ACTIVE TEMPERATURE CONTROL OF PIEZOELECTRIC MEMBRANE-BASED MICRO-ELECTROMECHANICAL DEVICES

CROSS-REFERENCE TO RELATED APPLICATIONS

The present application is related to commonly owned U.S. Pat. No. 7,579,753, to R. Shane Fazzio, et al. entitled TRANSDUCERS WITH ANNULAR CONTACTS and filed on Nov. 27, 2006; and U.S. Pat. No. 7,538,477 to R. Shane Fazzio, et al. entitled MULTI-LAYER TRANSDUCERS WITH ANNULAR CONTACTS and filed on Apr. 19, 2007. The entire disclosures of these related patents are specifically incorporated herein by reference.

BACKGROUND

Transducers are used in a wide variety of electronic applications. One type of transducer is known as a piezoelectric transducer. A piezoelectric transducer comprises a piezoelectric material disposed between electrodes. The application of a time-varying electrical signal will cause a mechanical vibration across the transducer; and the application of a time-varying mechanical signal will cause a time-varying electrical signal to be generated by the piezoelectric material of the transducer. One type of piezoelectric transducer may be based on bulk acoustic wave (BAW) resonators and film bulk acoustic resonators (FBARs). As is known, certain FBARs and BAW devices over a cavity in a substrate, or otherwise suspending at least a portion of the device will cause the device to flex in a time varying manner. Such transducers are often referred to as membranes.

Among other applications, piezoelectric transducers may be used to transmit or receive mechanical and electrical signals. These signals may be the transduction of acoustic signals, for example, and the transducers may be functioning as microphones (mics) and speakers and the detection or emission of ultrasonic waves. As the need to reduce the size of many components continues, the demand for reduced-size transducers continues to increase as well. This has lead to comparatively small transducers, which may be micromachined according to technologies such as micro-electromechanical systems (MEMS) technology, such as described in the related applications.

The materials that comprise the membrane often have properties that are temperature dependent. Notably, the piezoelectric materials, electrodes and contacts are temperature dependent. For example, FBAR devices in which the material of the piezoelectric element is aluminum nitride (AlN) and the material of the electrodes is molybdenum (Mo), have a resonance frequency that depends on temperature, which has an impact on device performance. Moreover, in certain applications, membrane-based devices will be commonly subjected to increased temperatures relative to the ideal temperature or design point, while in other applications the membranes are subjected to reduced temperatures relative to the ideal temperature or design point.

What is needed, therefore, is an apparatus that overcomes at least the drawbacks of known transducers discussed above.

SUMMARY

In accordance with a representative embodiment, an apparatus, comprises: a substrate; a microelectronic ultrasonic transducer (MUT) disposed over the substrate; and a thermoelectric device proximate to the MUT and configured to provide heat to and remove heat from the MUT.

In accordance with another representative embodiment, a microelectromechanical (MEMs) device, comprises: a microelectronic ultrasonic transducer (MUT); and a thermoelectric device disposed proximate to the MUT and configured to provide heat to and remove heat from the MUT.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

As used herein, the terms 'a' or 'an', as used herein are defined as one or more than one.

In addition to their ordinary meanings, the terms 'substantial' or 'substantially' mean to with acceptable limits or degree to one having ordinary skill in the art. For example, 'substantially cancelled' means that one skilled in the art would consider the cancellation to be acceptable.

In addition to their ordinary meanings, the terms 'approximately' mean to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known devices, materials and manufacturing methods may be omitted so as to avoid obscuring the description of the representative embodiments. Nonetheless, such devices, materials and methods that are within the purview of one of ordinary skill in the art may be used in accordance with the representative embodiments.

Figure 1A:
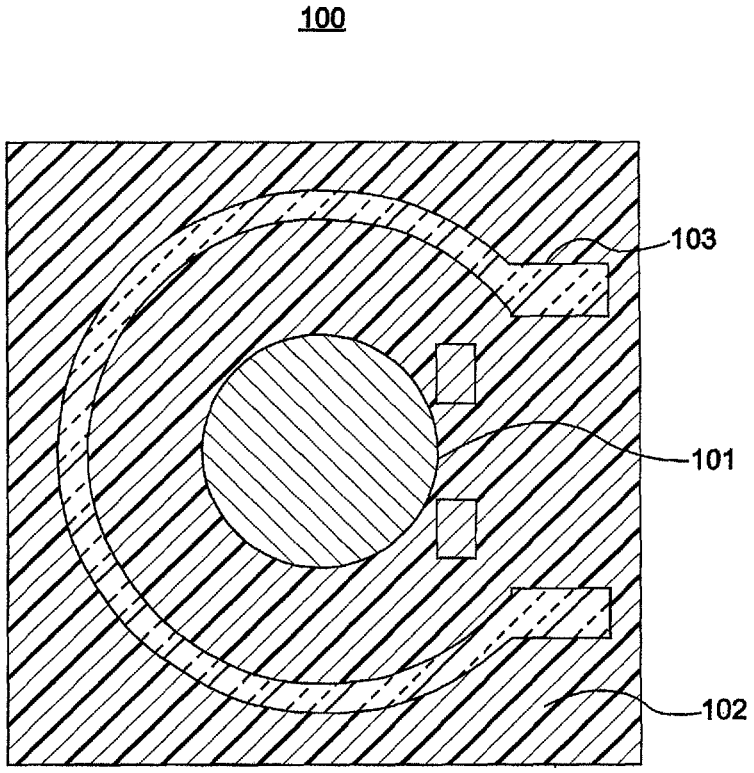
FIG. 1A shows a top view of a temperature compensated MEMs device in accordance with a representative embodiment in which the temperature compensating element substantially surrounds the MEM device.

FIG. 1A shows a top view of a temperature compensated MEMs device 100 in accordance with a representative embodiment. The device 100 comprises a transducer 101 disposed over a substrate 102. Illustratively, the transducer 101 is a membrane device operative to oscillate by flexing over a substantial portion of the active area thereof. The transducer 101 comprises micromachined ultrasonic transducers (MUTs). The MUT comprise a piezoelectric MUT (pMUT) or a capactive MUT (cMUT). pMuts are illustratively based on film bulk acoustic (FBA) transducer technology or bulk acoustic wave (BAW) technology. These types of transducers are known to those of ordinary skill in the art. Regardless of whether the transducer 101 comprises a pMUT or a cMUT, the transducer 101 is contemplated for use in a variety of applications. These applications include, but are not limited to microphone applications, ultrasonic transmitter applications and ultrasonic receiver applications. As will become clearer as the present description continues, the transducer 101 of the present teachings benefits from cooling, or heating, or both, to achieve and maintain a performance specification, for example.

Additional details of the transducer 101 implemented as a pMUT are described in the referenced applications to Fazzio, et al. Moreover, the transducer 101 may be fabricated according to known semiconductor processing methods and using known materials. Illustratively, the structure of the transducer 101 may be as described in one or more of the following U.S. Pat. No. 6,642,631 to Bradley, et al.; U.S. Pat. Nos. 6,377,137 and 6,469,597 to Ruby; U.S. Pat. No. 6,472,954 to Ruby, et al.; and may be fabricated according to the teachings of U.S. Pat. Nos. 5,587,620, 5,873,153 and 6,507,583 to Ruby, et al. The disclosures of these patents are specifically incorporated herein by reference. It is emphasized that the structures, methods and materials described in these patents are representative and other methods of fabrication and materials within the purview of one of ordinary skill in the art are contemplated.

The MEMs device 100 also comprises a temperature compensating element (TCE) 103. The TCE 103 may be a one of a variety of known thermoelectric elements based, for example, on simple resistive heating or Peltier and Thomson effects. For example, in certain embodiments, the TCE 103 may comprise a heating element such as a distributed resistive element, such as a resistor (or film Peltier technology). Illustratively, the TCE 103 is integrated into the process flow during fabrication of the transducer 101. For example, in certain embodiments, the resistive element may be of the type used in known semiconductor processing and may be effected by metallization processes, or diffusion processes, or both, to garner the desired resistance characteristics. Notably, the heating element need not be disposed over the surface of the substrate 102, but rather can be provided in the substrate 102.

In a representative embodiment, the TCE 103 can be integrated in the vicinity of the transducer 101. Illustratively, the transducer 101 is provided over the substrate 102 and beneath the transducer 101. As described more fully below, the TCE 103 can driven through the same signal connections within the or through separate contacts and drivers. In addition, having both cooling and heating capabilities allow for a control of the operation temperature through a feedback loop.

Figure 1B:
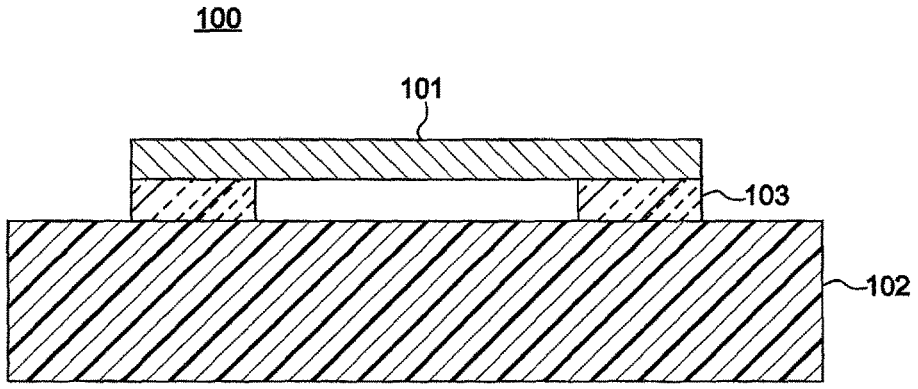
FIG. 1B shows a cross-sectional view of a temperature compensated MEMs device in which the temperature compensating element is below the membrane and incorporated in the substrate of the MEM device, in accordance with a representative embodiment.

FIG. 1B shows a cross-sectional view of a cross-sectional view of a temperature compensated MEMs device 100 in which the TCE 103 is provided below the membrane and incorporated in the substrate 102 of the MEM device, in accordance with a representative embodiment. Notably, the MEMs device 100 comprises features common to those described in connection with the embodiment of FIG. 1A, and these common details are not repeated to avoid obscuring the description of the present embodiments. As shown the transducer 101 is elevated over the substrate 102, to provide the membrane structure. Alternatively, the transducer 101 may be disposed over a cavity or 'swimming pool' (not shown) in a manner described in referenced patents above, and as is known to one of ordinary skill in the art.

As noted, the TCE 103 is incorporated into the substrate 102. In particular, in the present embodiment, the TCE 103 is fabricated in the process flow of fabricating the MEMs device 100. Beneficially, the incorporation of the TCE 103 in the flow of fabricating the MEMs device 100 provides an integrated transducer with heating/cooling capability. As described herein, many devices useful in the TCE 103 are amenable to semiconductor processing used in fabricating the MEMs device 100.

In operation, based on feedback from a thermocouple or similar temperature sensor, the TCE 103 is driven to heat or cool the transducer 101 to a particular desired operating temperature or desired operating temperature range. This process continues to ensure the maintaining of the temperature to a desired level or range for a particular application. Generally, the TCE 103 provides performance stability, prevents freezing of transducer 101 and condensation of moisture on the transducer 101. Illustratively, the performance stability comprises objectives such as maintaining function at a specified frequency, or maintaining sensitivity of the transducer 101 by maintaining the temperature of the device.

Figure 2:
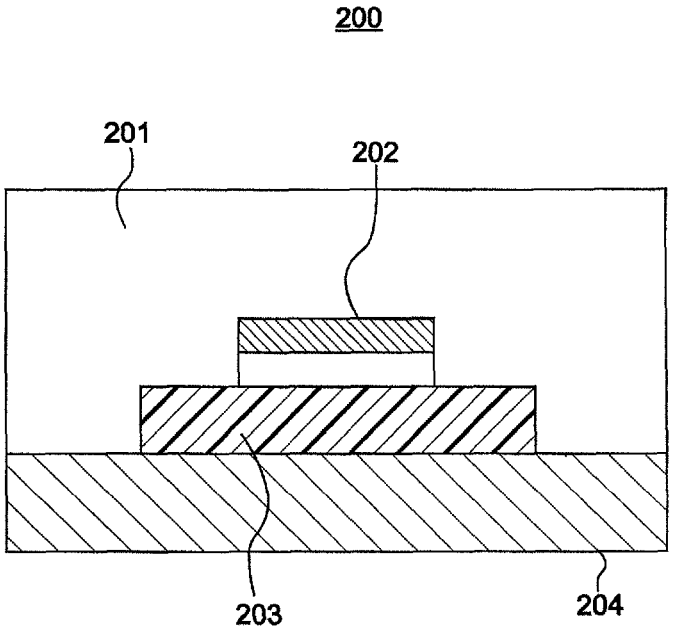
FIG. 2 shows a cross-sectional view of a temperature compensated MEMs device accordance with a representative embodiment in which the temperature compensating element is below the MEM device but inside the MEM package

FIG. 2 shows a cross-sectional view of a temperature compensated MEMs package ("MEMs package") 200 accordance with a representative embodiment. The MEMs package 200 includes features common to the embodiments described in connection with FIGS. 1A and 1B. These features are generally not repeated in order to avoid obscuring the description of the presently described embodiments.

The MEMs package 200 comprises a package 201. The package 201 may comprise one of a number of known materials and may be fabricated according to one of a number of known methods. The MEMs package 200 comprises a MEMs die 202, which comprises the transducer 101 (see FIGS. 1A and 1B). The MEMs die 202 may also comprise electronic components and electrical interconnects. For example, the MEMs die 202 may comprise a controller, a thermocouple or other temperature sensor, and the interconnections between the various components (not shown in FIG. 2). The MEMs die 202 is fabricated according to known semiconductor processing methods and from known materials, including those described in the above-referenced patents and patent applications that describe transducer fabrication.

The MEMs die 202 is provided over a TCE 203. The TCE 203 may comprise thermoelectric device commercially available from Micropelt Gmbh of Frieberg, Germany. Illustrative devices from Micropelt Gmbh include, but are not limited to Peltier Coolers (for cooling) and Thermogenerators (for heating). Alternatively, the TCE 203 comprises a thermoelectric cooler or a thermoelectric heater commercially available from TE Technologies of Traverse City, Mich. In the representative embodiments shown, the TCE 203 is in direct contact with and beneath the MEMs die 202, and in turn rests on the package substrate 204. Alternatively, the TCE 203 may be provided beneath the MEMs die 202 with a layer of material (not shown) provided between the MEMs die 202 and the TCE 203. For example, if the TCE 203 is a heating element, the protective material may be an insulator to ensure that the MEMs die 202 is not in direct contact with heating elements that may damage the MEMs die 202. Still alternatively, the TCE 203 may be disposed above the MEMs die 202. In certain embodiments, the TCE 203 may be in direct contact with an upper surface of the MEMs die 202, while in other embodiments, a layer of protective material may be provided between the MEMs die 202 and the TCE 203.

Figure 3:
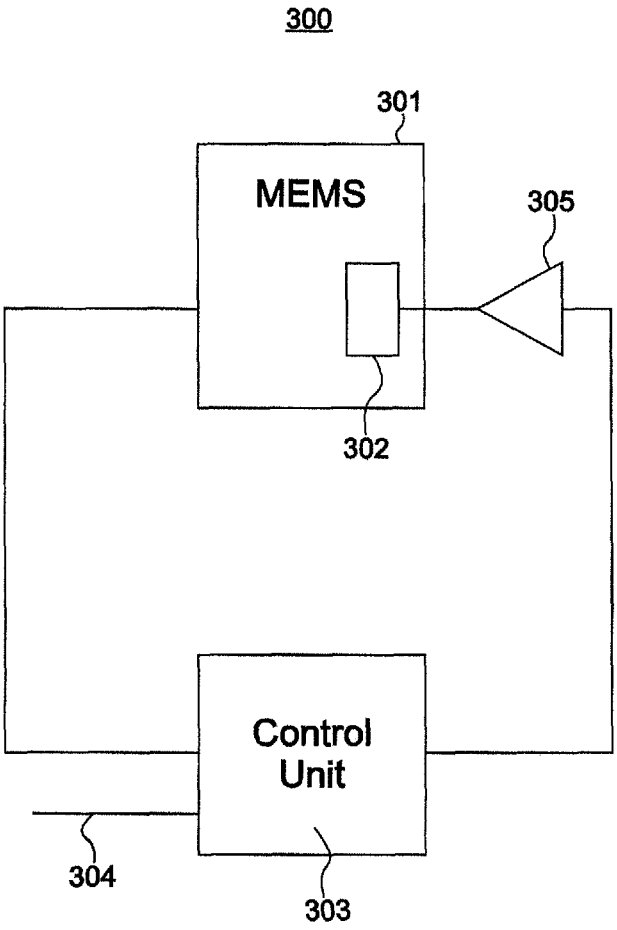
FIG. 3 shows a simplified schematic diagram of a temperature compensated MEMs device comprising a circuit to control the temperature in accordance with a representative embodiment.

FIG. 3 shows a simplified schematic diagram of an apparatus 300 in accordance with a representative embodiment. The MEMs apparatus 300 includes features common to the embodiments described in connection with FIGS. 1A, 1B and 2. These features are generally not repeated in order to avoid obscuring the description of the presently described embodiments.

The apparatus 300 comprises a MEMs device 301. The MEMs device 301 may comprise the MEMs device 100 described in connection with the embodiments of FIGS. 1A and 1B, or may comprise the MEMs die 202 described in connection with FIG. 2. The apparatus 300 also comprises a TCE 302. As described in connection with the embodiments of FIGS. 1A-2, the TCE 302 may be in contact with or adjacent to the MEMs device 301 in order to heat or cool the MEMs device 301 as required to maintain its operating temperature substantially at a desired level or substantially within a desired range. The apparatus 300 further comprises a control unit 303. The control unit 303 comprises one or more of: a processor; a microprocessor; an application specific integrated circuit (ASIC); and a programmable logic device (PLD) such as a field programmable gate array (FPGA). Software useful in the control function of the MEMs device 301 may be instantiated in the control unit 303.

The control unit 303 comprises an external input 304 and a feedback input from the MEMs device 301. The external input 304 may comprise a bus or other connection and may provide feedback from an external thermocouple or temperature sensor (not shown). Additionally, updating of the control unit and other data may be provided via the external input 304. The feedback input may comprise data related to the MEMs and its operation, including but not limited to, operating frequency, impedance, and temperature from a thermocouple or sensor of the MEMs device 301. These data may be sent on a regular basis using a clocking circuit (not shown), or may be in response to a query generated in and sent by the control unit 303. The control unit 303 provides an output to a driver 305. The driver 305 provides the control information to the TCE 302 or provides the query to the MEMs device 301 for its operation.

The control information provided to the TCE 302 sets an operating point of the TCE 302 so that the MEMs device 301 is maintained at a desired operational level. The control information can be updated in response to the feedback input to change the operating point of the TCE 302. As described above, controlling the operating point of the TCE is effected, for example to provide performance stability of the MUT of the MEMs device 301 or to prevent freezing of the MUT of the MEMs device and condensation of moisture on the MUT or the MEMs device 301.

The various components of the apparatus 300 may be fabricated using known semiconductor fabrication methods and materials and may be instantiated on a single die, or may comprise individual components in a package. Moreover, some but not all of the components of the apparatus may be instantiated in a single die and then packaged with those that are not.

In view of this disclosure it is noted that the temperature compensated MEMs devices, transducers and apparatuses useful in controlling the operating temperature of MEMs devices can be implemented in a variety of materials, variant structures, configurations and topologies. Moreover, applications other than small feature size transducers may benefit from the present teachings. Further, the various materials, structures and parameters are included by way of example only and not in any limiting sense. In view of this disclosure, those skilled in the art can implement the present teachings in determining their own applications and needed materials and equipment to implement these applications, while remaining within the scope of the appended claims.

The invention claimed is:

1. An apparatus, comprising:
a substrate;
a microelectronic ultrasonic transducer (MUT) disposed over the substrate; and
a thermoelectric device proximate to the MUT and configured to provide heat to, and remove heat from the MUT.

2. An apparatus as claimed in claim 1, wherein the MUT is a piezoelectric MUT (pMUT).

3. An apparatus as claimed in claim 2, wherein the pMUT comprises a membrane comprising a lower electrode, a piezoelectric element and an upper electrode.

4. An apparatus as claimed in claim 1, wherein the MUT is a capacitive MUT (cMUT).

5. An apparatus as claimed in claim 1, wherein the thermoelectric device is a Peltier effect device.

6. An apparatus as claimed in claim 1, wherein the thermoelectric device is a Thompson effect device.

7. An apparatus as claimed in claim 1, wherein the thermoelectric device is disposed over the substrate and between the substrate and the MUT.

8. A microelectromechanical (MEMs) device, comprising:
a microelectronic ultrasonic transducer (MUT); and
a thermoelectric device disposed proximate to the MUT and configured to provide heat to, and remove heat from the MUT.

9. A MEMs device as claimed in claim 8, wherein the MUT is a piezoelectric MUT (pMUT).

10. A MEMs device as claimed in claim 8, wherein the MUT is a capacitive MUT (cMUT).

11. A MEMs device as claimed in claim 8, wherein the thermoelectric device is a Peltier effect device.

12. A MEMs device as claimed in claim 8, wherein the thermoelectric device is a Thompson effect device.

13. A MEMs device as claimed 8, further comprising a substrate, and the thermoelectric device is disposed over the substrate and between the substrate and the MUT.

14. A MEMs device, comprising:
an apparatus, comprising: a microelectronic ultrasonic transducer (MUT); and
a thermoelectric device disposed proximate to the MUT and configured to provide heat to, and remove heat from the MUT; and
a control unit configured to set and adjust an operating point of the thermoelectric device.

15. A MEMs device as claimed in claim 14, wherein the control unit comprises a feedback input configured to provide data from the MUT.

16. A MEMs device as claimed in claim 15, wherein the feedback input comprises one or more of a temperature and an operating frequency.

17. A MEMs device as claimed in claim 14, wherein the thermoelectric device is a Peltier effect device.

18. A MEMs device as claimed in claim 14, wherein the thermoelectric device is a Thompson effect device.

* * * * *